US006955159B2

(12) United States Patent
Ogawa

(10) Patent No.: US 6,955,159 B2
(45) Date of Patent: Oct. 18, 2005

(54) CARBON CANISTER FOR USE IN EVAPORATIVE EMISSION CONTROL SYSTEM OF INTERNAL COMBUSTION ENGINE

(75) Inventor: Masahiro Ogawa, Yokohama (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 10/872,465

(22) Filed: Jun. 22, 2004

(65) Prior Publication Data

US 2004/0261777 A1 Dec. 30, 2004

(30) Foreign Application Priority Data

Jun. 24, 2003 (JP) ..... 2003-178910

(51) Int. Cl.[7] ..... F02M 33/02
(52) U.S. Cl. ..... 123/519
(58) Field of Search ..... 123/698, 519, 123/518, 520; 95/273, 901, 286

(56) References Cited

U.S. PATENT DOCUMENTS 4,300,918 A * 11/1981 Cary ..... 95/268
4,693,393 A 9/1987 DeMinco et al.
5,718,209 A * 2/1998 Scardino et al. ..... 123/519
2001/0039881 A1 11/2001 Moriyama et al.
2002/0174857 A1 11/2002 Reddy et al.

FOREIGN PATENT DOCUMENTS

JP 2003-003914 A 1/2003
WO WO 2004/007939 A1 1/2004

* cited by examiner

*Primary Examiner*—Bibhu Mohanty
(74) *Attorney, Agent, or Firm*—Foley & Lardner LLP

(57) ABSTRACT

First and second chambers are coaxially arranged and have substantially the same cross sectional area. First and second activated charcoal masses are respectively received in the first and second chambers. A labyrinth structure is arranged between respective first ends of the first and second chambers. An atmospheric air inlet port is provided by a second end of the second chamber. A third chamber is arranged beside the coaxially arranged first and second chambers. The third chamber has a first end positioned near a second end of the first chamber and a second end positioned near the second end of the second chamber. A third activated charcoal mass is received in the third chamber. A connector passage extends between the second end of the first chamber and the first end of the third chamber to provide a fluid connection between the first and third chambers. A fuel vapor inlet port is provided by the second end of the third chamber, and a fuel vapor outlet port is also provided by the second end of the third chamber.

14 Claims, 10 Drawing Sheets

CARBON CANISTER FOR USE IN EVAPORATIVE EMISSION CONTROL SYSTEM OF INTERNAL COMBUSTION ENGINE

BACKGROUND OF THE INVENTION

1. Field of the Invention

The present invention relates in general to an evaporative emission control system of an internal combustion engine, and more particularly to a carbon canister which is practically employed in the evaporative emission control system.

2. Description of the Related Art

Hitherto, for suppressing atmospheric pollution from motor vehicles powered by internal combustion engines, various evaporative emission control systems have been proposed and put into practical use. Some of them are of a type which employs a carbon canister to capture any fuel vapors (viz., HC) coming from the fuel tank. That is, the carbon canister prevents the vapors from escaping into the atmosphere. The carbon canister generally comprises a canister case which is filled with activated charcoal mass which adsorbs the fuel vapors. The canister case is formed at one end with an atmospheric air inlet port and at the other with both a fuel vapor inlet port and a fuel vapor outlet port. These three ports are communicated through flow passages defined in the activated charcoal mass.

Upon stopping of the engine, fuel vapors from the fuel tank are led into the canister through the fuel vapor inlet port and adsorbed (or trapped) by the activated charcoal mass. Only air that has left the fuel vapors therefrom is discharged to the atmosphere through the atmospheric air inlet port.

While, under operation of the engine with a canister purging mode, a certain negative pressure is applied to the interior of the canister from an intake system of the engine through the fuel vapor outlet port. With this, atmospheric air is led into the canister through the atmospheric air inlet port to pick up the trapped fuel vapors and carry the same to an intake manifold of the intake system of the engine through the fuel vapor outlet port. The fuel vapors thus led to the intake manifold become part of the air/fuel mixture entering the engine cylinders to burn. The action of clearing the trapped fuel vapors from the canister is called "purging". The air used for purging the canister (more specifically, the activated charcoal mass received therein) is called "purging air".

Due to inherent construction of the carbon canister, the trapped fuel vapors therein have such a concentration distribution characteristic that the fuel vapor concentration lowers as approaching the atmospheric air inlet port. However, because of the shape of the canister wherein the activated carbon is packed in a continuous space in the canister case, a so-called vapor migration phenomenon takes place wherein due to adsorption equilibrium, the trapped fuel vapors diffuse and move toward a lower concentration zone, that is, toward the atmospheric air inlet port. Thus, undesired leakage of the fuel vapors into the atmosphere increases with passing of time.

SUMMARY OF THE INVENTION

For solving the above-mentioned undesired leakage of the fuel vapors, an improved carbon canister is proposed by Japanese Laid-open Patent Application (Tokkai) 2003-003914. The carbon canister of this publication has first and second vapor trapping chambers arranged in a vapor flow passage which leads to an atmospheric air inlet port. However, even this improved carbon canister fails to provide the evaporative emission control system with a satisfied performance. Actually, the carbon canister shows a considerable pressure loss between the first and second vapor trapping chambers because a cross sectional area of the second vapor trapping is considerably small as compared with that of the first vapor tramping chamber.

It is therefore an object of the present invention to provide a carbon canister for use in an evaporative emission control system of an automotive internal combustion engine, which is free of the above-mentioned shortcoming.

According to the present invention, there is provided a carbon canister for use in an evaporative emission control system of an automotive internal combustion engine, in which undesired vapor migration phenomenon is minimized and undesired pressure drop between two vapor trapping chambers is minimized.

In accordance with a first aspect of the present invention, there is provided a carbon canister which comprises first and second chambers which are coaxially arranged and have substantially the same cross sectional area; first and second activated charcoal masses respectively received in the first and second chambers; a labyrinth structure arranged between respective first ends of the first and second chambers so that the first and second chambers are connected through a limited fluid communication; an atmospheric air inlet port provided by a second end of the second chamber; a third chamber arranged beside the coaxially arranged first and second chambers, the third chamber having a first end positioned near a second end of the first chamber and a second end positioned near the second end of the second chamber; a third activated charcoal mass received in the third chamber; a connector passage extending between the second end of the first chamber and the first end of the third chamber to provide a fluid connection between the first and third chambers; a fuel vapor inlet port provided by the second end of the third chamber; and a fuel vapor outlet port provided by the second end of the third chamber.

In accordance with a second aspect of the present invention, there is provided an evaporative emission control system of a motor vehicle powered by an internal combustion engine, which comprises a carbon canister including first and second chambers which are coaxially arranged and have substantially the same cross sectional area; first and second activated charcoal masses respectively received in the first and second chambers; a labyrinth structure arranged between respective first ends of the first and second chambers so that the first and second chambers are connected through a limited fluid communication; an atmospheric air inlet port provided by a second end of the second chamber; a third chamber arranged beside the coaxially arranged first and second chambers, the third chamber having a first end positioned near a second end of the first chamber and a second end positioned near the second end of the second chamber; a third activated charcoal mass received in the third chamber; a connector passage extending between the second end of the first chamber and the first end of the third chamber to provide a fluid connection between the first and third chambers; a fuel vapor inlet port provided by the second end of the third chamber; and a fuel vapor outlet port provided by the second end of the third chamber; a charging pipe extending from a fuel tank of the vehicle to the fuel vapor inlet port of the third chamber; and a purge pipe extending from a negative pressure producing area of an intake pipe of the engine to the fuel vapor outlet port of the third chamber.

DETAILED DESCRIPTION OF THE EMBODIMENTS

In the following, three embodiments 100, 200 and 300 of the present invention will be described in detail with reference to the accompanying drawings.

For ease of understanding, various directional terms, such as, right, left, upper, lower, rightward and the like are used in the following description. However, such terms are to be understood with respect to only a drawing or drawings on which a corresponding part or portion is shown.

Figure 1:
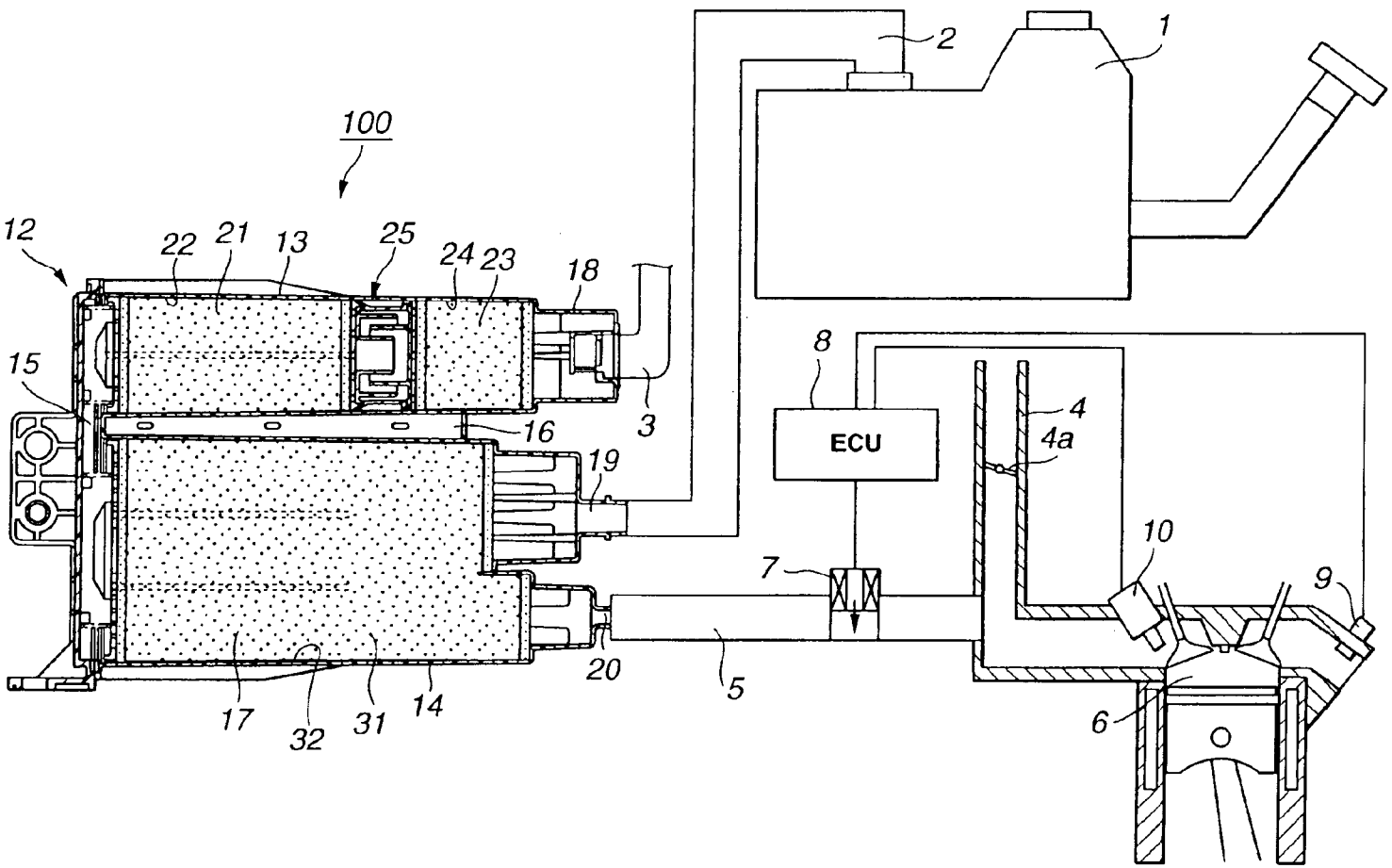
FIG. 1 is a block diagram of an evaporative emission control system in which a carbon canister of a first embodiment of the present invention is practically employed.
Figure 2:
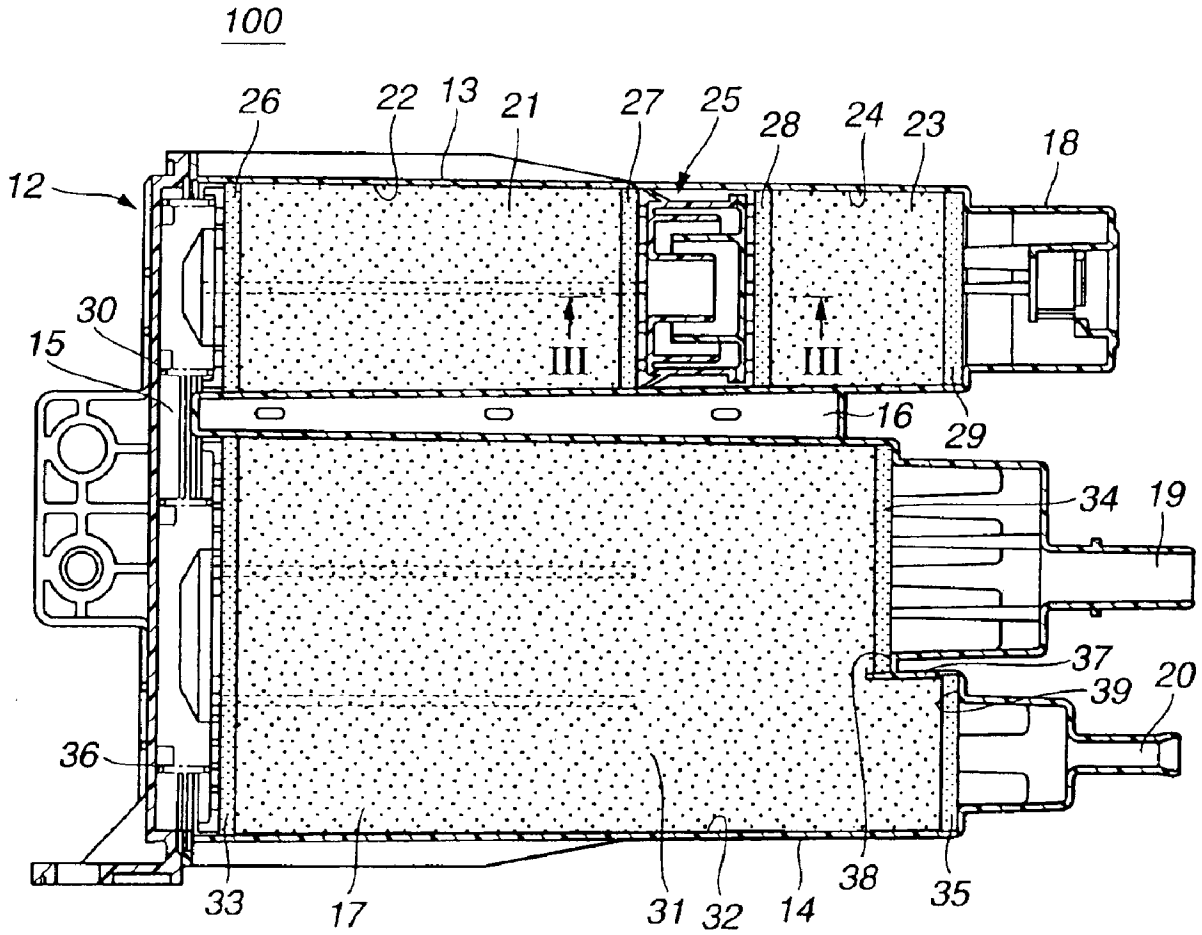
FIG. 2 is a sectional view of the carbon canister of the first embodiment.

Referring to FIGS. 1 to 7, particularly FIGS. 1 and 2, there is shown a carbon canister 100 which is a first embodiment of the present invention.

As is best shown in FIG. 2, carbon canister 100 comprises a generally cylindrical case 12 of a molded plastic, which includes a first hollow portion 13 and a second hollow portion 14 which are disposed on each other and extend in parallel with each other.

These two hollow portions 13 and 14 have respective left open ends which are integrally connected to spaced portions of a connector passage portion 15. Thus, a generally U-shaped passage 17 is defined in and by the plastic case 12, which comprises an interior of first hollow portion 13, that of connector passage portion 15 and that of second hollow portion 14.

As shown, first and second hollow portions 13 and 14 have a reinforcing rib 16 integrally interposed therebetween.

As shown in FIG. 1, first hollow portion 13 is formed at a right end thereof with an atmospheric air inlet port 18.

Within first hollow portion 13, there are packed a first activated charcoal mass 21 and a second activated charcoal mass 23 which are arranged in series in such a manner that the second activated charcoal mass 23 is positioned between first activated charcoal mass 23 and atmospheric air inlet port 18. Preferably, the vapor adsorbing/releasing ability (or working capacity) of the second activated charcoal mass 23 is higher than that of the first activated charcoal mass 21.

Within second hollow portion 14, there is packed a third activated charcoal mass 31 which functions to selectively adsorb and release fuel vapors, as will be described in detail hereinafter.

Second hollow portion 14 is formed at a right end thereof with both a fuel vapor inlet port 19 and a fuel vapor outlet port 20.

As will be understood from FIG. 1, upon stop of an associated internal combustion engine "ENG", fuel vapors in a fuel tank 1 is led into second hollow portion 14 through a charging pipe 2 and fuel vapor inlet port 19 and trapped by activated charcoal mass 31 packed therein. Any fuel vapors which have slipped through activated charcoal mass 31 are led to first hollow portion 13 and trapped by first activated charcoal mass 21 and second activated charcoal mass 23. Air in first hollow portion 13, which has the fuel vapors sufficiently released therefrom, is gently discharged to the atmosphere through atmospheric air inlet port 18 and an air inlet pipe 3.

Under operation of engine "ENG" with a canister purging mode, a negative pressure produced in an intake pipe 4 downstream of a throttle valve 4*a* is applied to the interior of carbon canister 100 through a purge pipe 5 and fuel vapor outlet port 20. With this application of negative pressure to the carbon canister 100, atmospheric air is led into the interior of carbon canister 100 through air inlet pipe 3 and air inlet port 18. Due to this air introduction into carbon canister 100, the fuel vapors are released from activated charcoal masses 21, 23 and 31 and led into intake pipe 4 together with the atmospheric air through purge pipe 5 and finally burnt in each combustion chamber 6 of engine "ENG".

Installed in purge pipe 5 is an electromagnetic valve 7 by which an amount of the fuel vapors directed toward intake pipe 4 and a timing of feeding the fuel vapors to intake pipe 4 are electronically controlled or adjusted. As shown, the valve 7 is controlled by an engine control unit 8 which has a microcomputer installed therein. That is, the amount of fuel vapors directed toward intake pipe 4 and the fuel vapor feeding timing are controlled in accordance with an operation condition of the engine "ENG". If desired, the valve 7 may be of a mechanical type which enforcedly opens/closes purge pipe 5 in accordance with a magnitude of the negative pressure in intake pipe 4.

If desired, charging pipe 2 may be provided with a negative pressure cut valve (viz., check valve), which shuts charging pipe 2 when the interior of carbon canister 100 shows a negative pressure higher than a predetermined degree.

By processing an information signal from an all range type exhaust air/fuel ratio sensor 9 installed in an exhaust system, engine control unit 8 controls, in a feedback manner, an air/fuel ratio of air/fuel mixture fed to combustion chambers 6. More specifically, engine control unit 8 controls an operation of fuel injectors 10 through which a fuel is injected for cylinders of the engine "ENG". It is to be noted that the all range type exhaust air/fuel ratio sensor 9 can issue a continuous output in accordance with the exhaust air/fuel ratio in the exhaust gas.

As is seen from the drawing, atmospheric air inlet port 18, fuel vapor inlet port 19 and fuel vapor outlet port 20 are all arranged at the right end, that is, at the same end of the canister 100. That is, these three ports 18, 19 and 20 are placed at the same side, which facilitates the work for piping these ports 18, 29 and 20 to associated parts without need of a larger space.

As is best seen from FIG. 2, first hollow portion 13 of the case 12 comprises a first cylindrical chamber 22 in which the first activated charcoal mass 21 is packed, a second cylindrical chamber 24 in which the second activated charcoal mass 23 is packed and a cylindrical labyrinth structure 25 which is arranged between first and second cylindrical chambers 22 and 24.

It is to be noted that first and second cylindrical chambers 22 and 24 have a substantially same cross sectional area.

As is described hereinabove, the vapor adsorbing/releasing ability (or working capacity) of the second activated charcoal mass 23 is higher than that of the first activated charcoal mass 21. Generally, the vapor adsorbing/releasing ability of activated charcoal mass increases as the specific heat of the same increases.

As shown in FIG. 2, first cylindrical chamber 22 is equipped at left and right ends thereof with first and second filter members 26 and 27 respectively.

Like the above, second cylindrical chamber 24 is equipped at left and right ends thereof with third and fourth filters 28 and 29 respectively.

Cylindrical labyrinth structure 25 is arranged between second and third filters 27 and 28, which connects first and second cylindrical chambers 22 and 24 with a limited fluid communication.

Figure 3:
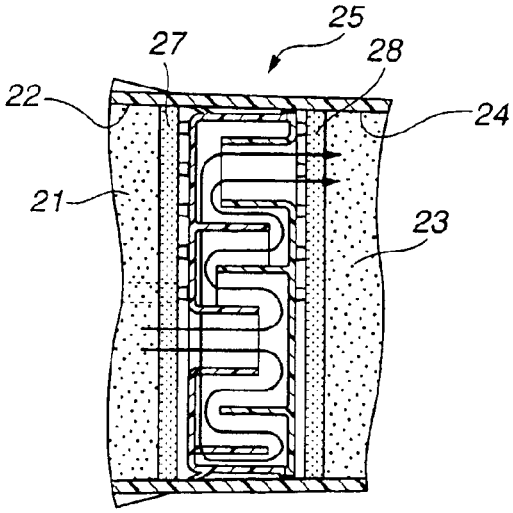
FIG. 3 is a sectional view taken along the line III—III of FIG. 2, showing a labyrinth structure.

As is best seen from FIG. 3, for the limited fluid communication between first and second cylindrical chambers 22 and 24, cylindrical labyrinth structure 25 has thin and zig-zag passages defined therein.

Referring back to FIG. 2, a first coil spring 30 is arranged at a left end of first hollow portion 13, by which a unit including first filter member 26, first activated charcoal mass 21, second filter member 27, cylindrical labyrinth structure 25, third filter member 28, second activated charcoal mass 23 and fourth filter member 29 is constantly pressed rightward against a shoulder portion (no numeral) provided behind atmospheric air inlet port 18. With this, the unit is steadily held in first hollow portion 13.

Activated charcoal mass 21 in first cylindrical chamber 22 is of a crushed granulated type, and activated charcoal mass 23 in second cylindrical chamber 24 is of a briquett type.

Figure 4:
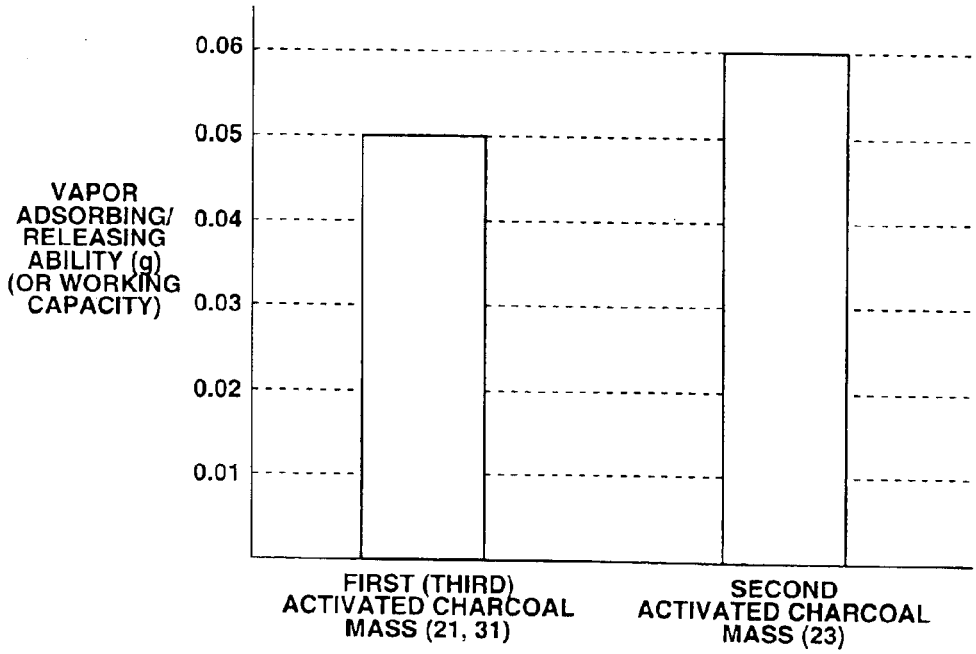
FIG. 4 is a graph showing a vapor adsorbing/releasing ability (or working capacity) of first, second and third activated charcoal masses employed in the first embodiment.

As is seen from the graph of FIG. 4, the vapor adsorbing/releasing ability (or working capacity) of activated charcoal mass 23 is higher than that of activated charcoal mass 21.

Referring back to FIG. 2, second hollow portion 14 has a third cylindrical chamber 32 in which the third activated charcoal mass 31 is packed. As is seen from the drawing, third cylindrical chamber 31 is larger in size than the above-mentioned first and second cylindrical chambers 22 and 24. Activated charcoal mass 31 in third cylindrical chamber 31 is the crushed granulated type and thus somewhat poorer in vapor adsorbing/releasing ability than the activated charcoal mass 23 in second cylindrical chamber 24.

As shown in the drawing, third cylindrical chamber 32 is equipped at a left end thereof with a fifth filter member 33, and at a right end thereof with sixth and seventh filter members 34 and 35. Sixth filter member 34 is put in a base part of fuel vapor inlet port 19 and seventh filter member 35 is put in a base part of fuel vapor outlet port 20, as shown.

A second coil spring 36 is arranged at a left end of third cylindrical chamber 32, by which a unit including fifth filter member 33, the third activated charcoal mass 31, sixth filter member 34 and seventh filter member 35 is constantly pressed rightward against a partition wall 37 provided between and behind fuel vapor inlet port 19 and fuel vapor outlet port 20, as shown. With this, the unit is steadily held in third cylindrical chamber 32 of second hollow portion 14.

Partition wall 37 is integral with second hollow portion 14 and comprises a first seat portion 38 by which sixth filter member 34 is held and a second seat portion 39 by which seventh filter member 35 is held.

As is seen from FIG. 2, first and second seat portions 38 and 39 are arranged at different positions with respect to an axial direction of second hollow portion 14. In the illustrated embodiment, second seat portion 39 is positioned away from connector passage portion 15 as compared with first seat portion 38.

As is seen from this drawing, fuel vapor inlet port 19 and fuel vapor outlet port 20 are communicated through the third activated charcoal mass 31 and sixth and seventh filter members 34 and 35.

The above-mentioned first, second, third, fourth, fifth, sixth and seventh filter members 26, 27, 28, 29, 33, 34 and 35 are of a permeable layered type made of polyurethane foam, non-woven fabric or the like.

As has been described hereinafore, in the case 12, there is defined a generally U-shaped passage 17 in and along which the three activated charcoal masses 23, 21 and 31 are arranged in series in the above-mentioned manner. Accordingly, a compact size of the case 12 and a sufficient length of passage 17 are both achieved at the same time in the carbon canister 100 of the present invention.

As has been mentioned hereinabove, first and second cylindrical chambers 22 and 24 of first hollow portion 13 have a substantially same cross sectional area.

It is now to be noted that the rate (viz., L/D) of the axial length (L) of first cylindrical chamber 22 to the diameter (D) of the same is substantially the same as that of third cylindrical chamber 32. As has been mentioned hereinabove, in these first and third cylindrical chambers 22 and 32, there are disposed the same kind of activated charcoal masses 21 and 31.

It is also to be noted that the L/D rate of second cylindrical chamber 24 is smaller than that of first cylindrical chamber 22 (or third cylindrical chamber 32). As has been mentioned hereinabove, in the second cylindrical chamber 24, there is packed the activated charcoal mass 23 that is superior to the activated charcoal mass 21 or 31 in the vapor adsorbing/releasing ability.

In first and third cylindrical chambers 22 and 32, the L/D rate is from about 2 to about 5. While, in second cylindrical chamber 24, the L/D rate is smaller than 1.

That is, in the first embodiment 100, the following inequalities are satisfied by the first, second and third cylindrical chambers 22, 24 and 32:

$$2 \leqq L_1/D_1 \leqq 5 \quad (1)$$

$$L_2/D_2 < 1 \quad (2)$$

$$2 \leqq L_3/D_3 \leqq 5 \quad (3)$$

wherein:

$L_1$: axial length of first cylindrical chamber 22

$D_1$: diameter of first cylindrical chamber 22

$L_2$: axial length of second cylindrical chamber 24

$D_2$: diameter of second cylindrical chamber 24

$L_3$: axial length of third cylindrical chamber 32

$D_3$: diameter of third cylindrical chamber 32

Figure 5:
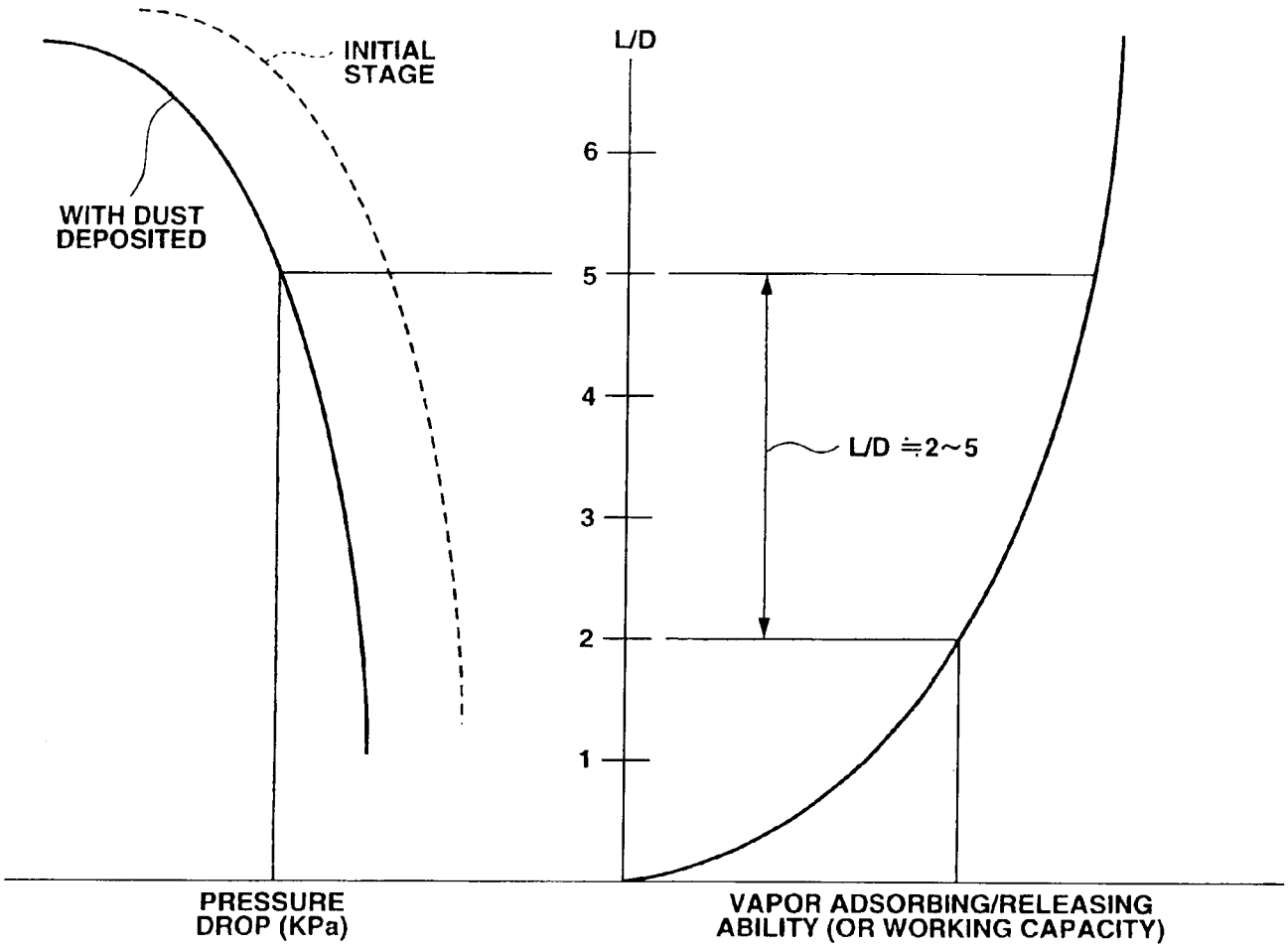
FIG. 5 is a graph showing a vapor adsorbing/releasing ability of activated charcoal mass and a pressure loss caused by the same with respect to a length/diameter rate (or L/D rate) of a cylindrical case of a carbon canister.

FIG. 5 is a graph depicting vapor adsorbing/releasing ability and pressure drop of a test sample of cylindrical carbon canister with respect to the L/D rate.

As is understood from this graph, the vapor adsorbing/releasing ability increases with increase of the L/D rate. However, with increase of the L/D rate, the pressure drop also increases. That is, with decrease of the L/D rate, the pressure drop decreases and the vapor adsorbing/releasing ability decreases.

In view of the characteristics of the tested cylindrical carbon canister depicted by the graph of FIG. 5, the following fact has been revealed.

That is, in order to effectively suppress leakage of fuel vapors from atmospheric air inlet port 18 while suppressing increase of the pressure drop, it is preferable that the L/D rate of second cylindrical chamber 24 is set lower than that of first cylindrical chamber 22. Furthermore, it is preferable that even when a certain amount of dust is deposited in each of cylindrical chambers 22 and 24, the interior of first hollow portion 13 is prevented from showing an excessive pressure drop.

Considering these preferable matters, the above-mentioned L/D rate setting for first, second and third cylindrical chambers 22, 24 and 32 have been determined by the inventor. If the chambers 22, 24 and 32 have each a cross sectional shape other than the circle, the diameter of a circle that has the same area as the cross sectional shape should be used for "D" of the L/D rate.

Furthermore, preferably, the amount of second activated charcoal mass 23 is set smaller than 2% to 20% of that of the first activated charcoal mass 21 or that of the third activated charcoal mass 31.

In the following, operation of carbon canister 100 of the first embodiment will be described with reference to FIG. 1.

For ease of explanation on the operation, the following description will be commenced with respect to a condition wherein engine "ENG" has just stopped.

Upon stop of the engine "ENG", fuel vapors in fuel tank 1 flows into second hollow portion 14 of canister 100 through charging pipe 2 and fuel vapor inlet port 19 and is directed toward atmospheric air inlet port 18 through the U-shaped passage 17. This flow of the fuel vapors toward the air inlet port 18 is enhanced particularly when the internal temperature of fuel tank 1 is high. During the flow in U-shaped passage 17, the fuel vapors are adsorbed by the third activated charcoal mass 31 in third cylindrical chamber 32. Any fuel vapors which have slipped through the activated charcoal mass 31 of third cylindrical chamber 32 are led through connector passage portion 15 into first cylindrical chamber 22 where the fuel vapors are adsorbed by the first activated charcoal mass 21. Almost all of the fuel vapors from third cylindrical chamber 32 are trapped by this first activated charcoal mass 21 of first cylindrical chamber 22. However, if any fuel vapors which have slipped through the activated charcoal mass 21 are present, they are directed toward the second activated charcoal mass 23 of second cylindrical chamber 24 through cylindrical labyrinth structure 25.

However, due to provision of labyrinth structure 25, the flow speed of the fuel vapors toward the second activated charcoal mass 23 of second cylindrical chamber 24 is reduced. This enhances the fuel vapor adsorption by first activated charcoal mass 21 in first cylindrical chamber 22. In second cylindrical chamber 24, the remaining fuel vapors are adsorbed by the second activated charcoal mass 23 while leaving air that is directed toward the atmosphere through atmospheric air inlet port 18 and air inlet pipe 3.

As is mentioned hereinabove, the fuel vapors from fuel tank 1 are forced to flow through the third activated charcoal mass 31, the first activated charcoal mass 21 and the second activated charcoal mass 23. Thus, almost all of the fuel vapors are adsorbed by carbon canister 100, and thus, leakage of the fuel vapors into the atmosphere is suppressed or at least minimized. Furthermore, since activated charcoal mass 23 in second cylindrical chamber 24 has a higher vapor adsorbing/releasing ability, the undesired leakage of the fuel vapors is much assuredly suppressed.

While, under operation of the engine "ENG" with a canister purging mode, purging is carried out in carbon canister 100. That is, under such operation of the engine "ENG", atmospheric air is introduced into carbon canister 100 through atmospheric air inlet port 18 because of the power of the negative pressure applied to the interior of the carbon canister 100 from intake pipe 4 of the engine "ENG". During flow in and along the U-shaped passage 17 toward fuel vapor outlet port 20, the atmospheric air picks up the trapped fuel vapors from all of the second activated charcoal mass 23, first activated charcoal mass 21 and third activated charcoal mass 31 and carries the same to intake pipe 4 for burning the same in the engine cylinders.

In the following, various advantageous features provided by carbon canister 100 of the first embodiment will be described.

Since labyrinth structure 25 is provided between first and second activated charcoal masses 21 and 23, the undesired fuel vapor migration from first cylindrical chamber 22 to second cylindrical chamber 24 is greatly obstructed or at least minimized under stop of the engine "ENG", and thus, the leakage of the fuel vapors into the atmosphere is greatly lowered.

Since first and second cylindrical chambers 22 and 24 have substantially the same cross sectional area, undesired pressure drop between these two chambers 22 and 24 is minimized.

Since second activated charcoal mass 23 that has a higher vapor absorbing/releasing ability is positioned just behind atmospheric air inlet port 18, purging of the second activated charcoal mass 23 is quickly carried out. Thus, at early stage of the purging mode, the second activated charcoal mass 23 can exhibit a full-release of fuel vapors therefrom. This is quite advantageous for obstructing the vapor leakage into the atmosphere that would take place upon stop of the engine "ENG".

Figure 6:
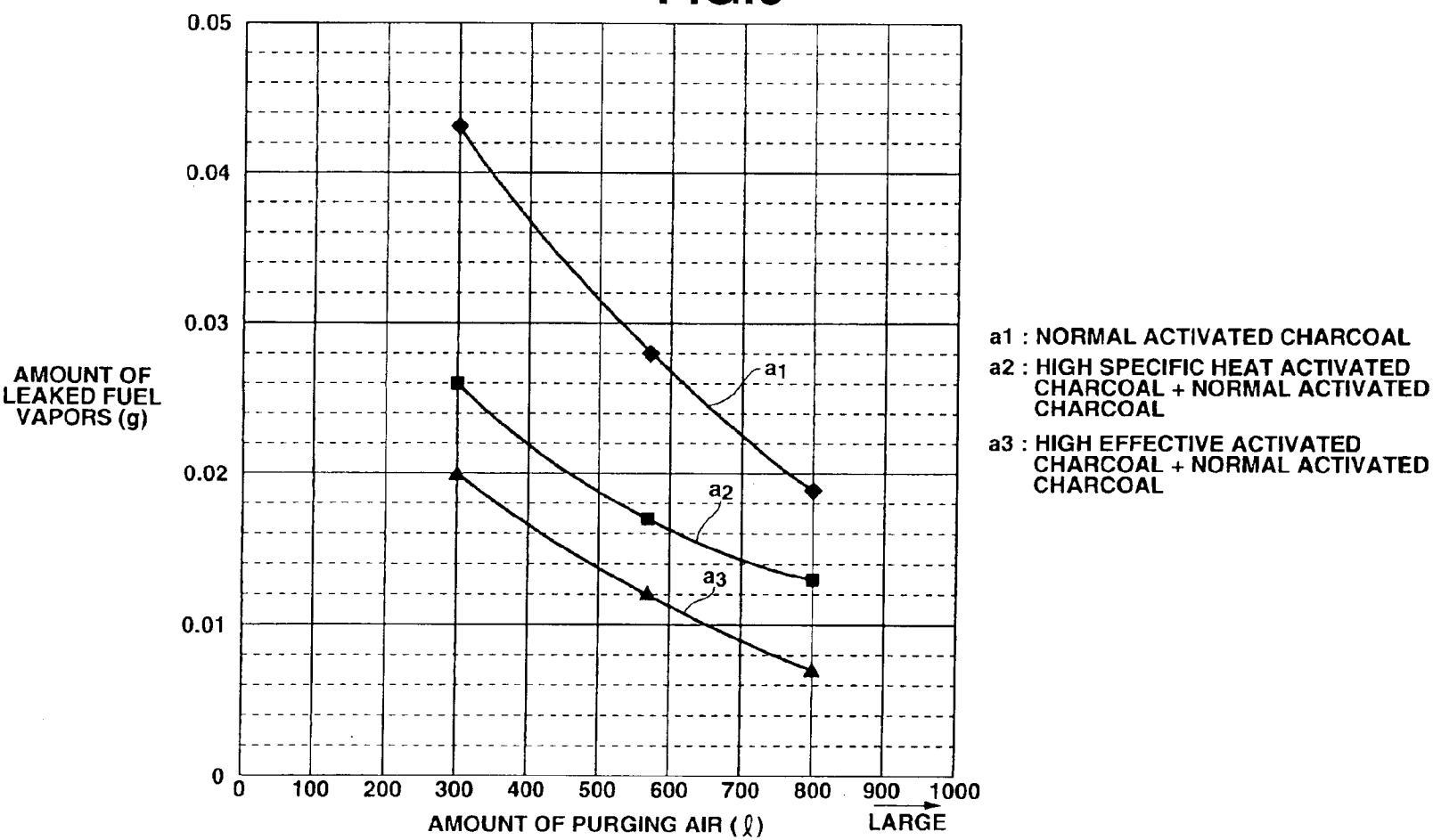
FIG. 6 is a graph depicting the results of an evaporation test (or vapor leakage test) applied to three types of carbon canisters.

FIG. 6 is a graph depicting the results of an evaporation test (or vapor leakage test). In the test, three types of carbon canisters "a1", "a2" and "a3" were examined in which the amount of leaked fuel vapors was measured in each canister "a1", "a2" or "a3". The tested carbon canisters were a first canister "a1" that contained only a normal activated charcoal mass, a second canister "a2" that contained a high specific heat activated charcoal mass and the normal activated charcoal mass and a third canister "a3" that contained a high effective activated charcoal mass and the normal activated charcoal mass. As is seen from this graph, second and third canisters "a2" and "a3" showed a higher emission suppression performance than first canister "a1". This proves that the combination of first and second activated charcoal masses 21 and 23 which are different in vapor absorbing/releasing ability can exhibit a high emission suppression performance.

Figure 7:
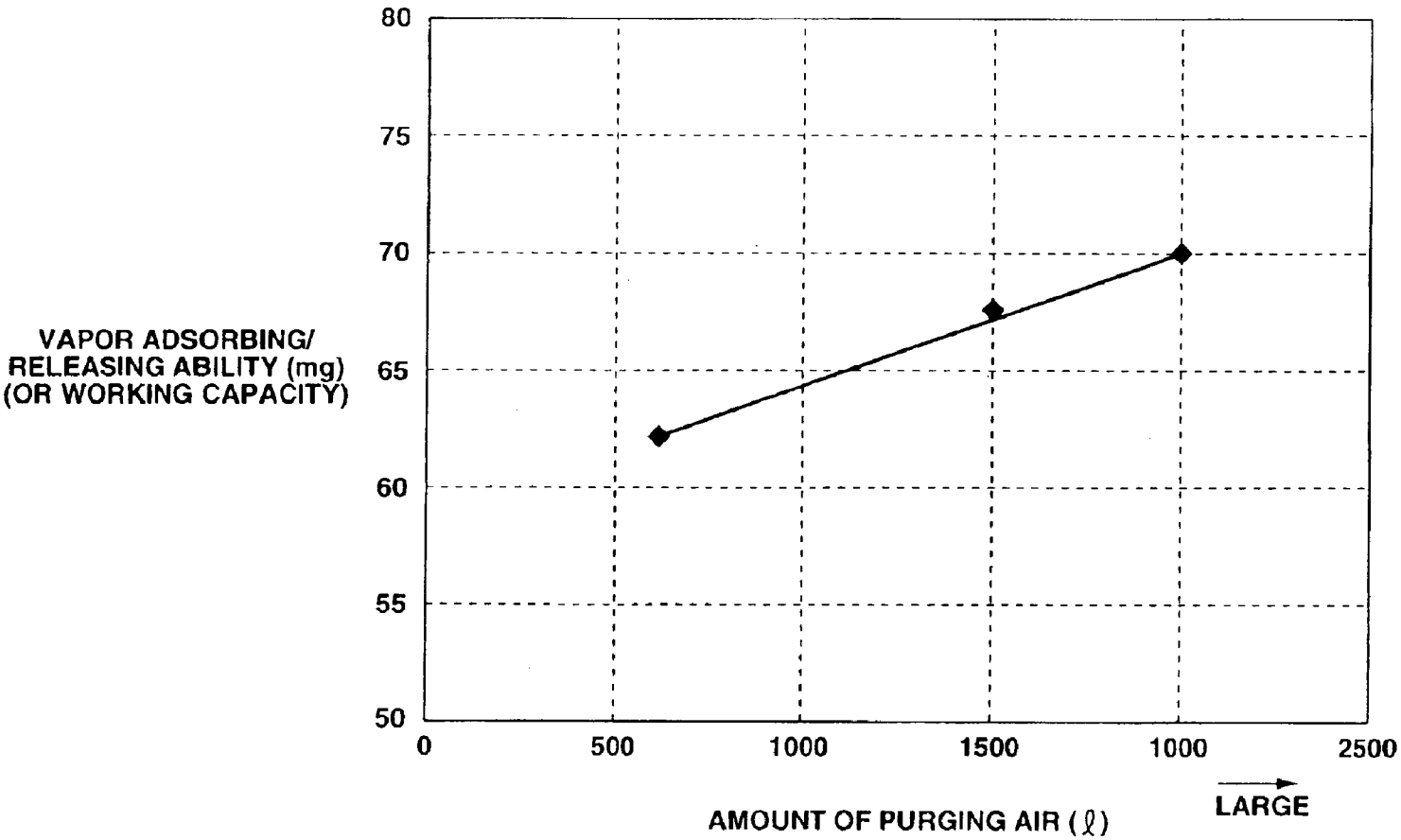
FIG. 7 is a graph depicting a relationship between an amount of purging air (viz., atmospheric air led into an activated charcoal mass) and the vapor adsorbing/releasing ability of the activated charcoal mass.

FIG. 7 is a graph depicting a relationship between an amount of purging air (viz., atmospheric air led into an activated charcoal mass) and the vapor adsorbing/releasing ability of the activated charcoal mass. As is understood from this graph, with increase of the purging air, the vapor adsorbing/releasing ability of the activated charcoal mass increases. Thus, when carbon canister 100 is fed with a larger amount of atmospheric air under the canister purging mode, second, first and third activated charcoal masses 23, 21 and 31 can effectively release the trapped fuel vapors therefrom.

The amount of purging air can be increased by expanding the engine operation range for the canister purging mode.

In the illustrated feedback type engine control system (see FIG. 1) using the all range type exhaust air/fuel ratio sensor 9 that detects the exhaust air/fuel ratio in a linear manner, a larger amount of atmospheric air can be fed to carbon canister 100 as compared with another feedback type engine control system that uses an oxygen sensor that detects the oxygen concentration in the exhaust gas.

As is seen from FIG. 1, between fuel vapor inlet port 19 and fuel vapor outlet port 20, there is placed the third activated charcoal mass 31. Accordingly, when, with the fuel vapors kept flowing from fuel tank 1 toward carbon canister 100 after stop of the engine "ENG", the engine "ENG" starts again, the fuel vapors from fuel tank 1 are prevented from being directly led to intake pipe 4. That is, upon starting of the engine "ENG", the fuel vapors are inevitably treated by the third activated charcoal mass 31 before being transferred to intake pipe 4, and thus, undesired exhaust emission impact, which induces an abnormally richer condition of air/fuel mixture, is suppressed.

If desired, one of first and second cylindrical chambers 22 and 24 may have another labyrinth structure installed therein. In this case, the vapor migration phenomenon is much assuredly suppressed.

Figure 8:
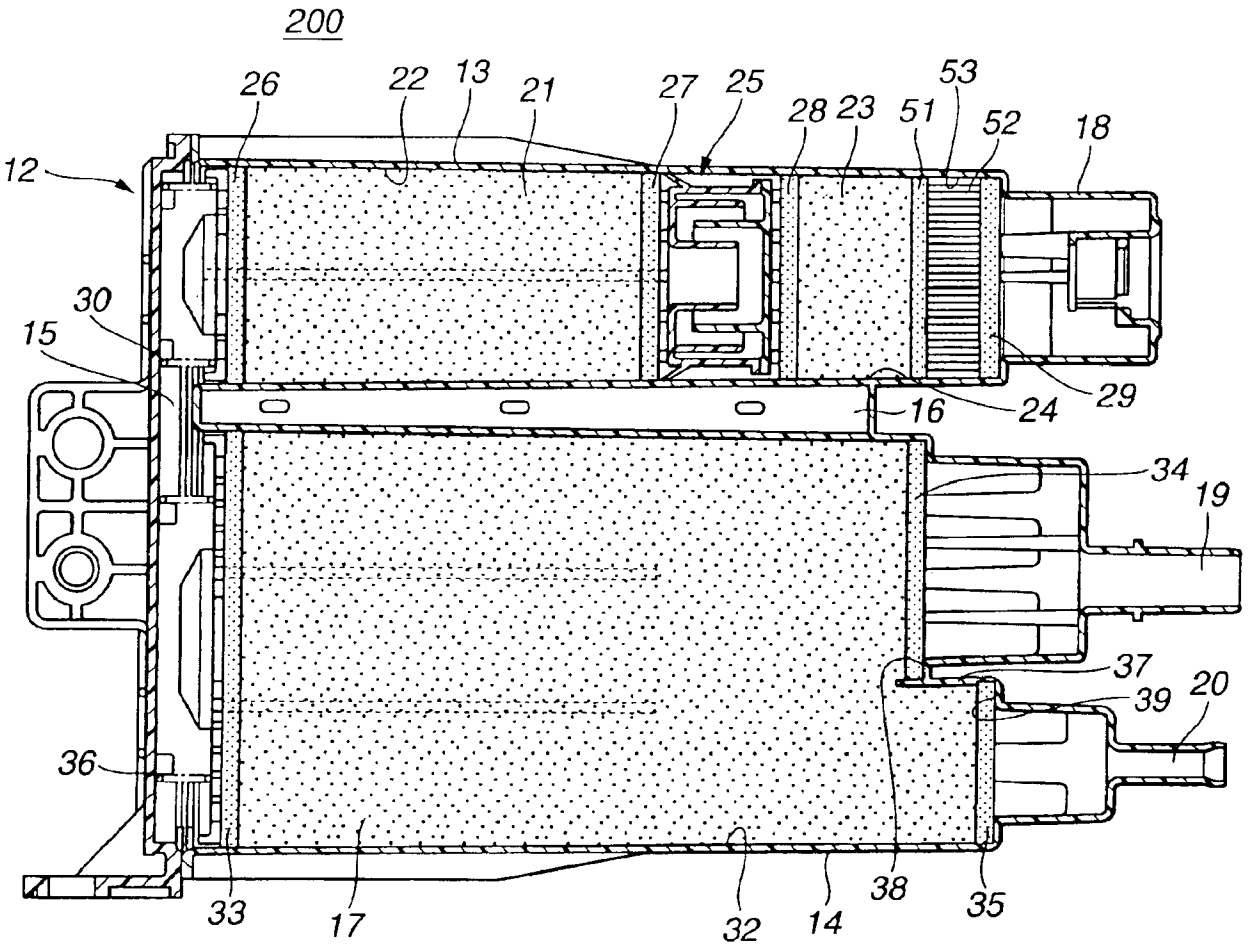
FIG. 8 is a sectional view of a carbon canister of a second embodiment of the present invention.

Referring to FIG. 8, there is shown a carbon canister 200 which is a second embodiment of the present invention.

Since the second embodiment 200 is similar in construction to the above-mentioned first embodiment 100, only portions that are different from those of the first embodiment 100 will be described in detail in the following.

As is understood from the drawing, in second cylindrical chamber 24 at a position close to atmospheric air inlet port 18, there is disposed a fourth activated charcoal mass 52. More specifically, the fourth activated charcoal mass 52 is formed into a honeycomb structure and an eighth filter member 51 is put between the fourth activated charcoal mass 52 and second activated charcoal mass 23. That is, due to provision of eighth filter member 51 in second cylindrical chamber 24, a fourth cylindrical chamber 53 is defined in which the honeycomb type activated charcoal mass 52 is disposed.

In this second embodiment 200, the L/D rate of first cylindrical chamber 22 and that of second cylindrical chamber 24 are both from about 2 to about 4. In third cylindrical chamber 32, the L/D rate is from about 2 to about 5.

That is, the following inequalities are satisfied by the second embodiment 200:

$$2 \leqq L_1/D_1 \leqq 4 \quad (4)$$

$$2 \leqq L_2/D_2 < 4 \quad (5)$$

$$2 \leqq L_3/D_3 \leqq 5 \quad (6)$$

wherein:

$L_1$: axial length of first cylindrical chamber 22

$D_1$: diameter of first cylindrical chamber 22

$L_2$: axial length of second cylindrical chamber 24

$D_2$: diameter of second cylindrical chamber 24

$L_3$: axial length of third cylindrical chamber 32

$D_3$: diameter of third cylindrical chamber 32

Like the other filter members 26, 27, 28, 29, 33, 34 and 35, eighth filter member 51 is of a permeable layered type made of polyurethane foam, non-woven fabric or the like.

Due to addition of fourth activated charcoal mass 52, the undesired leakage of the fuel vapors into the atmosphere is much assuredly suppressed. This carbon canister 200 is suitable for an evaporative emission control system incorporated with a hybrid type motor vehicle because the internal combustion engine of such vehicle has a less time for carrying out the purging mode for a carbon canister.

Figure 9:
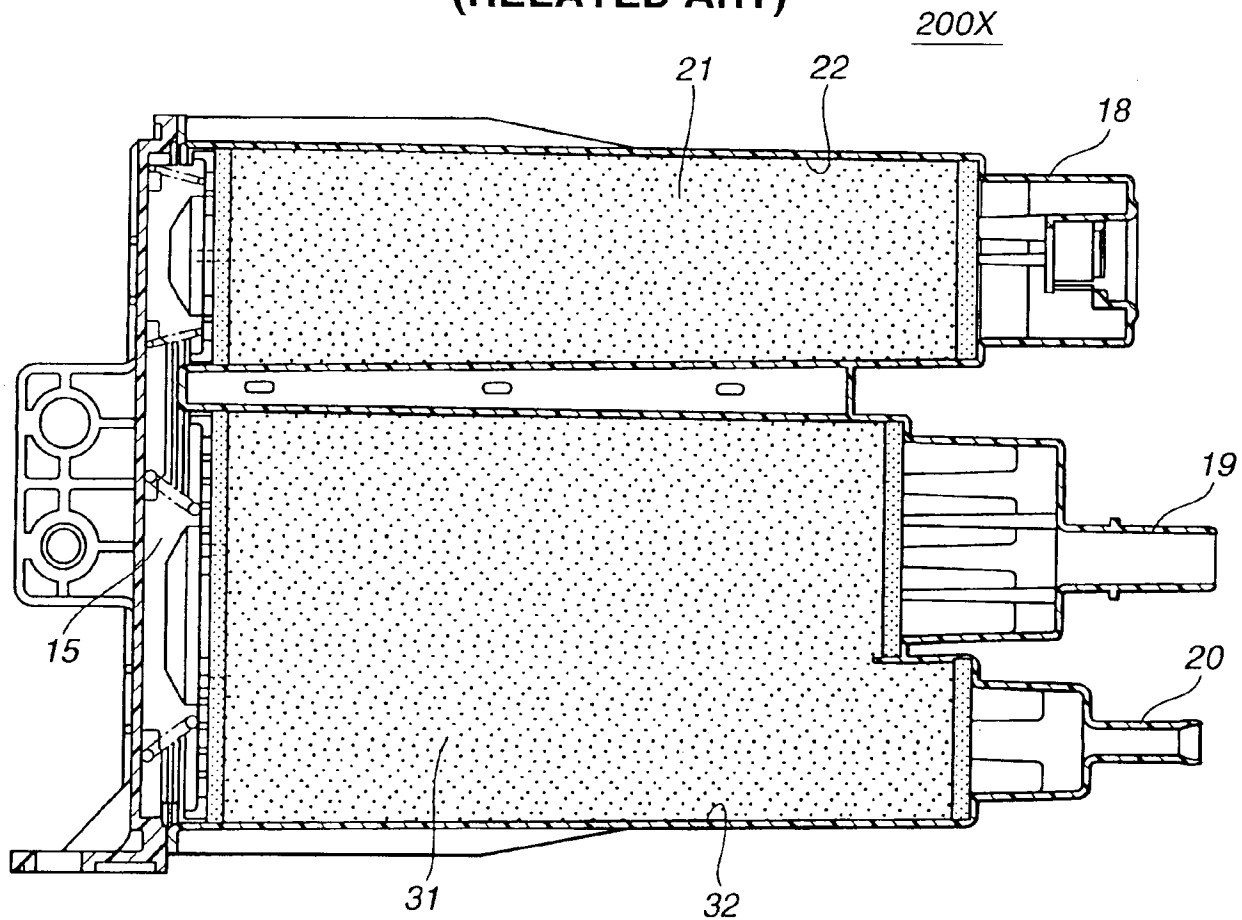
FIG.9 (RELATED ART)
FIG. 9 is a sectional view of a known carbon canister which was used as a reference sample for testing the performance of the carbon canister of the second embodiment.

For examining the performance of carbon canister 200 of the second embodiment, a comparison test was carried out between the carbon canister 200 and a known carbon canister 200X as shown in FIG. 9. The known carbon canister 200X comprises generally two parallel cylindrical chambers 22 and 32 which are connected through a connector passage portion 15, each chamber 22 or 32 being filled with the activated charcoal mass 21 or 31 of crushed granulated type. For the comparison, the two carbon canisters 200 and 200X were subjected to an evaporation test (or vapor leakage test) on a test bench, wherein for each carbon canister 200 or 200X, the amount of leaked fuel vapors was measured on a first day when the canister 200 or 200X was substantially new and on a second day when 24 hours had passed from the first day.

Figure 10:
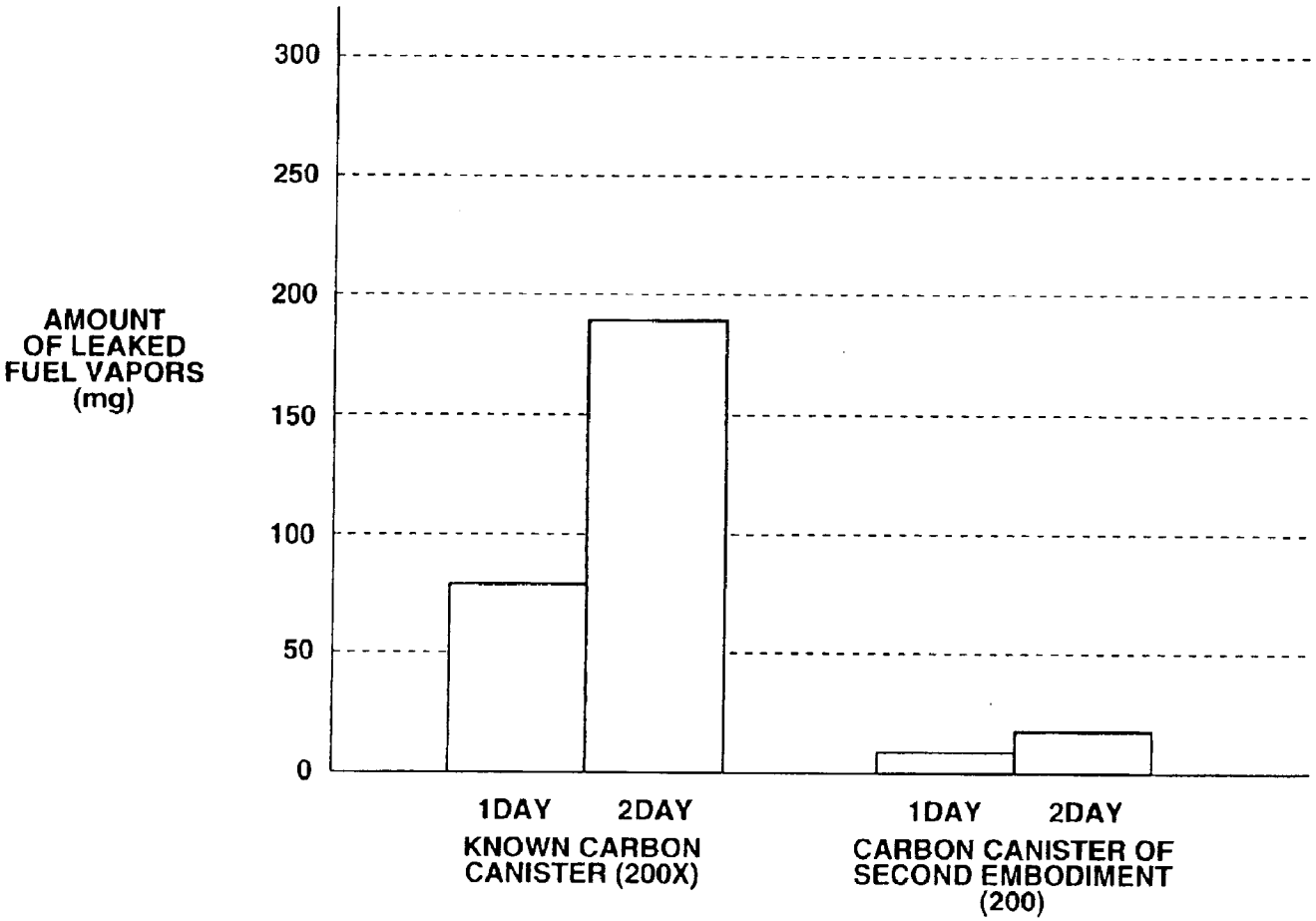
FIG. 10 is a graph showing the results of the performance test of the carbon canister of the second embodiment and the known carbon canister.

The results of the comparison test is shown by the graph of FIG. 10. As shown, carbon canister 200 of the second embodiment showed an excellent emission reduction performance as compared with the related canister 200X.

Figure 11:
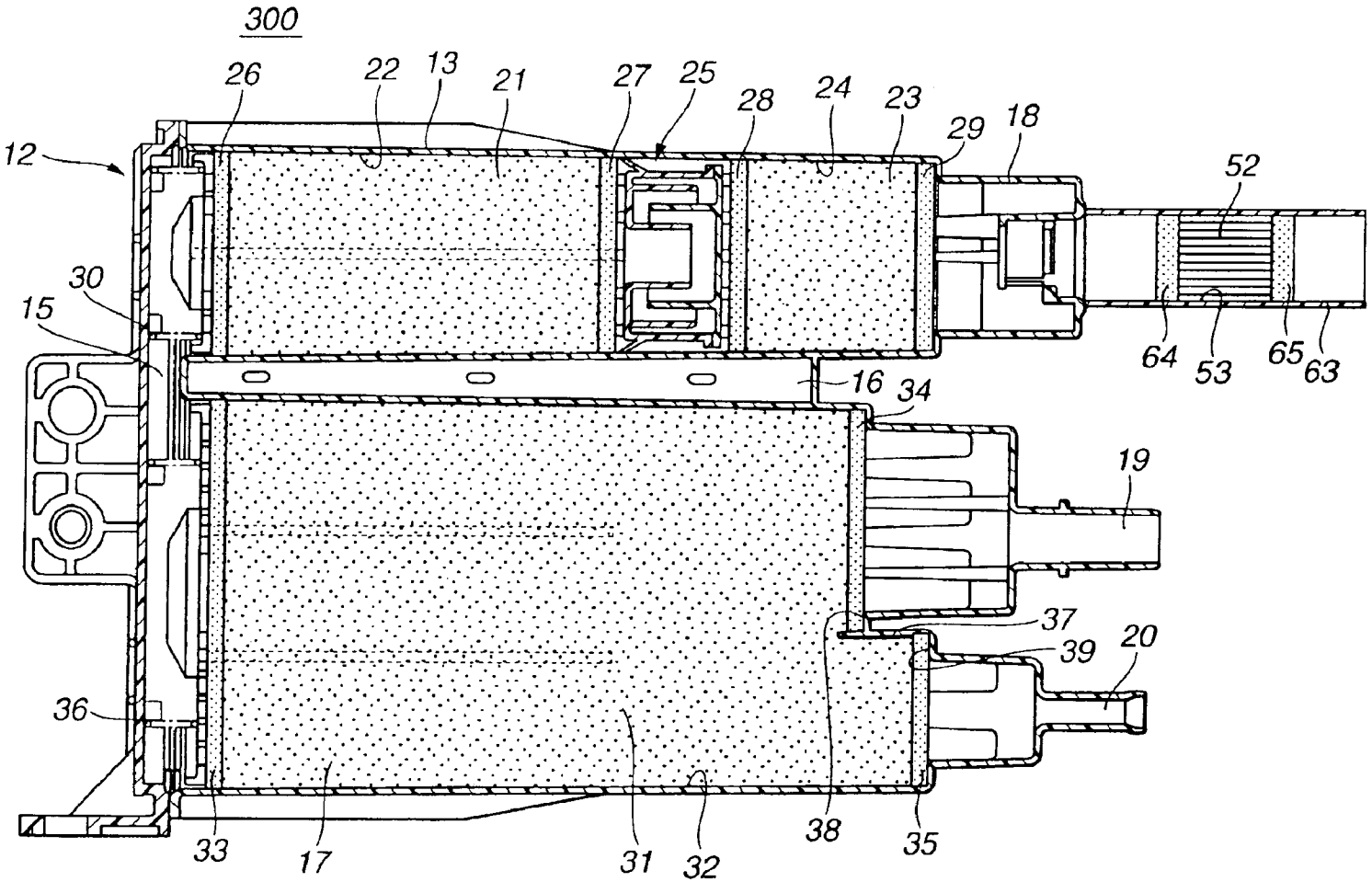
FIG. 11 is a sectional view of a carbon canister of a third embodiment of the present invention.

Referring to FIG. 11, there is shown a carbon canister 300 which is a third embodiment of the present invention.

Since the third embodiment 300 is similar in construction to the above-mentioned first embodiment 100, only portions that are different from those of the first embodiment 100 will be described in detail in the following.

As is understood from the drawing, from atmospheric air inlet port 18, there extends a pipe 63 in which a fourth activated charcoal mass 52 is disposed. More specifically, the fourth activated charcoal mass 52 is formed into a honeycomb structure and sandwiched between ninth and tenth filter members 64 and 65. That is, in the pipe 63, there is defined a fourth cylindrical chamber 53 in which the honeycomb type activated charcoal mass 52 is disposed.

In this third embodiment 300, the L/D rate of first cylindrical chamber 22 and that of second cylindrical chamber 24 are both from about 2 to about 4. In third cylindrical chamber 32, the L/D rate is from about 2 to about 5.

That is, the following inequalities are satisfied by the third embodiment 300:

$$2 \leqq L_1/D_1 \leqq 4 \quad (7)$$

$$2 \leqq L_2/D_2 < 4 \quad (8)$$

$$2 \leqq L_3/D_3 \leqq 5 \quad (9)$$

wherein:

$L_1$: axial length of first cylindrical chamber 22

$D_1$: diameter of first cylindrical chamber 22

$L_2$: axial length of second cylindrical chamber 24

$D_2$: diameter of second cylindrical chamber 24

$L_3$: axial length of third cylindrical chamber 32

$D_3$: diameter of third cylindrical chamber 32

Like the other filter members 26, 27, 28, 29, 33, 34 and 35, ninth and tenth filter members 64 and 65 are of a permeable layered type made of polyurethane foam, non-woven fabric or the like.

Due to addition of fourth activated charcoal mass 52, the undesired leakage of the fuel vapors into the atmosphere is much assuredly prevented. For the above-mentioned same reason, the carbon canister 300 is suitable for an evaporative emission control system incorporated with a hybrid type motor vehicle.

The entire contents of Japanese Patent Application 2003-178910 filed Jun. 24, 2003 are incorporated herein by reference.

Although the invention has been described above with reference to the embodiments of the invention, the invention is not limited to such embodiments as described above. Various modifications and variations of such embodiments may be carried out by those skilled in the art, in light of the above description.

What is claimed is:

1. A carbon canister comprising:

first and second chambers which are coaxially arranged and have substantially the same cross sectional area;

first and second activated charcoal masses respectively received in the first and second chambers;

a labyrinth structure arranged between respective first ends of the first and second chambers so that the first and second chambers are connected through a limited fluid communication;

an atmospheric air inlet port provided by a second end of the second chamber;

a third chamber arranged beside the coaxially arranged first and second chambers, the third chamber having a first end positioned near a second end of the first chamber and a second end positioned near the second end of the second chamber;

a third activated charcoal mass received in the third chamber;

a connector passage extending between the second end of the first chamber and the first end of the third chamber to provide a fluid connection between the first and third chambers;

a fuel vapor inlet port provided by the second end of the third chamber; and a fuel vapor outlet port provided by the second end of the third chamber.

2. A carbon canister as claimed in claim 1, in which the first, second and third chambers are cylindrical in shape, and in which the first and second cylindrical chambers have substantially the same cross section.

3. A carbon canister as claimed in claim 1, in which the second activated charcoal mass has a vapor adsorbing/releasing ability that is hither than that of the first activated charcoal mass.

4. A carbon canister as claimed in claim 1, in which the third activated charcoal mass has substantially the same vapor adsorbing/releasing ability as the first activated charcoal mass.

5. A carbon canister as claimed in claim 1, in which a passage defined by the second chamber, the labyrinth structure, the first chamber, the connector passage and the third chamber has a generally U-shape.

6. A carbon canister as claimed in claim 2, in which the following inequalities are satisfied by the first and second cylindrical chambers:

$$2 \leqq L_1/D_1 \leqq 5$$

$$L_2/D_2 < 1$$

wherein:

$L_1$: axial length of first cylindrical chamber $D_1$: diameter of first cylindrical chamber $L_2$: axial length of second cylindrical chamber $D_2$: diameter of second cylindrical chamber.

7. A carbon canister as claimed in claim 6, in which the following inequality is further satisfied by the third cylindrical chamber:

$$2 \leqq L_3/D_3 \leqq 5$$

wherein:

$L_3$: axial length of third cylindrical chamber $D_3$: diameter of third cylindrical chamber.

8. A carbon canister as claimed in claim 1, further comprising:

a fourth chamber arranged between the second chamber and the atmospheric air inlet port; and a fourth activated charcoal mass received in the fourth chamber, the fourth activated charcoal mass having a honeycomb structure.

9. A carbon canister as claimed in claim 8, in which the fourth chamber is defined by the second chamber, and in which the fourth chamber and the second chamber are partitioned by a filter member.

10. A carbon canister as claimed in claim 8, in which the fourth chamber is defined in a pipe that extends outward from the atmospheric air inlet port.

11. A carbon canister as claimed in claim 8, in which the following inequalities are satisfied by the first and second cylindrical chambers:

$$2 \leqq L_1/D_1 \leqq 4$$

$$2 \leqq L_2/D_2 \leqq 4$$

wherein:

$L_1$: axial length of first cylindrical chamber $D_1$: diameter of first cylindrical chamber $L_2$: axial length of second cylindrical chamber $D_2$: diameter of second cylindrical chamber.

12. A carbon canister as claimed in claim 11, in which the following inequality is further satisfied by the third cylindrical chamber:

$$2 \leqq L_3/D_3 \leqq 5$$

wherein:

$L_3$: axial length of third cylindrical chamber $D_3$: diameter of third cylindrical chamber.

13. An evaporative emission control system of a motor vehicle powered by an internal combustion engine, comprising:

a carbon canister including first and second chambers which are coaxially arranged and have substantially the same cross sectional area; first and second activated charcoal masses respectively received in the first and second chambers; a labyrinth structure arranged between respective first ends of the first and second chambers so that the first and second chambers are connected through a limited fluid communication; an atmospheric air inlet port provided by a second end of the second chamber; a third chamber arranged beside the coaxially arranged first and second chambers, the third chamber having a first end positioned near a second end of the first chamber and a second end positioned near the second end of the second chamber; a third activated charcoal mass received in the third chamber; a connector passage extending between the second end of the first chamber and the first end of the third chamber to provide a fluid connection between the first and third chambers; a fuel vapor inlet port provided by the second end of the third chamber; and a fuel vapor outlet port provided by the second end of the third chamber;

a charging pipe extending from a fuel tank of the vehicle to the fuel vapor inlet port of the third chamber; and a purge pipe extending from a negative pressure producing area of an intake pipe of the engine to the fuel vapor outlet port of the third chamber.

14. An evaporative emission control system as claimed in claim 13, further comprising:

an electromagnetic valve installed in the purge pipe to open and close the same;

an all range type exhaust air/fuel ratio sensor arranged in an exhaust system of the engine; and a control unit which controls the open/close operation of the electromagnetic valve in accordance with an information issued from the all range type exhaust air/fuel ratio sensor.

* * * * *